United States Patent [19]

Kaufman

[11] Patent Number: 4,987,882

[45] Date of Patent: Jan. 29, 1991

[54] ROOF MOUNTED KITCHEN HOOD GREASE EXHAUST BLOWERS

[75] Inventor: Arnold S. Kaufman, Studio City, Calif.

[73] Assignee: Renco Systems, Inc., Glendale, Calif.

[21] Appl. No.: 475,223

[22] Filed: Feb. 5, 1990

[51] Int. Cl.[5] ..... F24C 15/20

[52] U.S. Cl. ..... 126/299 D; 98/115.1; 126/299 R

[58] Field of Search ..... 126/299 D, 299 R, 299 E; 98/115.1; 55/242, 385 R, DIG. 36

[56] References Cited

U.S. PATENT DOCUMENTS

| | | | |
|---|---|---|---|
| 3,581,467 | 6/1971 | Donnelly | 126/299 E X |
| 3,731,462 | 5/1973 | Costarella et al. | 126/299 E X |
| 4,071,019 | 1/1978 | King | 126/299 E |
| 4,323,373 | 4/1982 | Fritz | 126/299 E X |
| 4,635,617 | 1/1987 | Simonsen | 126/299 E |
| 4,822,385 | 4/1989 | Strege et al. | 126/299 E X |
| 4,869,236 | 9/1989 | Blough | 126/299 E X |

FOREIGN PATENT DOCUMENTS

| | | | |
|---|---|---|---|
| 2139750 | 11/1984 | United Kingdom | 126/299 E |

*Primary Examiner*—Larry Jones

*Attorney, Agent, or Firm*—Beehler & Pavitt

[57] ABSTRACT

A roof mountable kitchen grease exhaust blower is constructed with hinged housing elements which can be raised for easy service access to all parts of the unit. A container collects grease draining from a discharge scoop and has a flotation separator for harmlessly eliminating water while retaining grease. Grease containment edges on the discharge scoop contain and collect grease being carried by the exhaust air stream along inner scoop surfaces. The discharge scoop has a curved bottom wall to encourage gravity flow of grease collecting on the scoop surfaces towards a drain opening.

9 Claims, 3 Drawing Sheets

ROOF MOUNTED KITCHEN HOOD GREASE EXHAUST BLOWERS

BACKGROUND OF THE INVENTION

1. Field of the Invention

This invention generally relates to the field of air ventilation systems and more particularly is directed to certain improvements in roof mounted exhaust blowers of the type used with kitchen hoods in commercial kitchens for removing smoke and grease laden air over cooking surfaces.

2. State of the Prior Art

Commercial kitchens, such as in restaurants and fast food outlets, frequently have a ventilation hood over stoves, grills, broilers and the like for collecting and exhausting the smoke and fumes generated by cooking processes. Hot grease-laden air rises into the hood, and is drawn into a duct by means of a motor driven blower mounted on the kitchen roof or adjacent area. The contaminated air is exhausted to the outdoors. Such installations are typically required by local ordinance and are therefore in widespread use. There are different manufacturers of such equipment and designs for the exhaust blowers vary in various details and features from one manufacturer to another, although the general mode of operation is similar.

A frequent problem with many kitchen exhaust blowers is the excessive accumulation of solid or semi-solid grease on various parts of the exhaust blower unit and on the adjacent roof and surrounding surface, creating a significant fire hazard.

Many existing grease exhaust blowers offer only restricted interior access and are difficult to clean and service for removal of accumulated grease. In such cases, the service life of the unit is reduced, and unsanitary conditions and the aforementioned fire hazard are allowed to persist. It it therefore highly desirable to provide kitchen exhaust blower units with easy access to all interior parts to ensure regular and thorough cleaning and servicing for optimum and safe performance.

Another common problem is that grease deposited on the walls of the air discharge scoop, typically found in these blowers for directing the air exhaust stream upwardly into the atmosphere, tends to be washed onto the roof surface by rain and snow precipitation. These discharge scoops usually have a receptacle which collects grease runoff from the scoop. The open scoop also collects large amounts of rain water or snow which likewise fill the grease receptacle. Since the grease tends to float on water, the grease accumulated in the receptacle is first to overflow onto the roof surface. Over a period of time, large puddles of roof top grease have been known to accumulate around exhaust blowers. Accumulated roof top grease is hazardous both from a sanitation and fire prevention point of view; it is unsightly; it can cause structural damage to the roof and building by leaking into cracks and crevices of the roof structure, and makes it more difficult and unpleasant for service personnel to reach the blower unit for servicing and cleaning.

It is therefore an important object in designing this type of equipment to minimize the amount of condensed grease which is ejected or spilled by the blower onto the surrounding roof surface.

A continuing need exist for cleaner, easier to service roof-top kitchen exhaust blowers for commercial kitchens.

SUMMARY OF THE INVENTION

The grease exhaust blower of this invention features a number of improvements which collectively serve to substantially improve access to all parts of the blower unit, increase the unit's reliability and significantly reduce the accumulation of condensed grease on the roof top surface adjacent to the blower unit.

More specifically, this invention is a roof mountable kitchen grease exhaust blower having a base which communicates through an exhaust air duct with a kitchen ventilation hood for extracting grease laden air over a cooking surface, a blower housing hinged to the base for movement between a closed operative position and a raised maintenance position, a discharge scoop fixed to the blower housing, and a blower wheel supported in the blower housing for exhausting air from the base through the scoop. The blower wheel is supported in a top housing hinged to the blower housing for movement between a closed operative position and an exposed maintenance position.

The top housing is hinged to the blower housing such that the motor is cantilevered and at least partially balances the weight of the blower wheel for easier tilting of the top housing to the exposed maintenance position.

The exhaust blower unit further includes a container for collecting condensed grease and fluids from a drain slot in the discharge scoop, including a flotation separator for eliminating rain and snow water while retaining grease in the container. Atmospheric precipitation unavoidably fills the grease collection box and unless precautions are taken will cause the grease to overflow onto the roof surface. In the improved system of this invention, the grease which tends to float on water is retained by a partition which has a low level opening through which water may pass into an adjacent compartment which has a higher level, overflow opening. As the level of water in the adjacent compartment reaches this higher level, it overflows harmlessly onto the roof surface. The grease remains trapped in the container for periodic removal by service personel.

Yet another novel feature includes provision of grease containment edges on the discharge scoop about a discharge opening, the edges being bent inwardly to the discharge opening to contain and collect grease being carried by the exhaust air stream along inner scoop surfaces toward the opening, thereby keeping the grease from discharging onto a surrounding roof surface or the atmosphere.

The discharge scoop has two vertical side walls connected by a bottom wall bent progressively between a generally horizontal lower portion adjacent to the blower housing and a generally vertical end portion, the drain opening being in the lower portion, so as to encourage gravity flow of grease collecting on the side walls and the end portion towards the drain opening for collection in the aforementioned container and flotation separator.

BRIEF DESCRIPTION OF THE DRAWINGS

FIG. 5A is a fragmentary elevational section of the discharge scoop showing the inturned grease containment flange at the scoop edge.

DETAILED DESCRIPTION OF THE PREFERRED EMBODIMENTS

Figure 1:
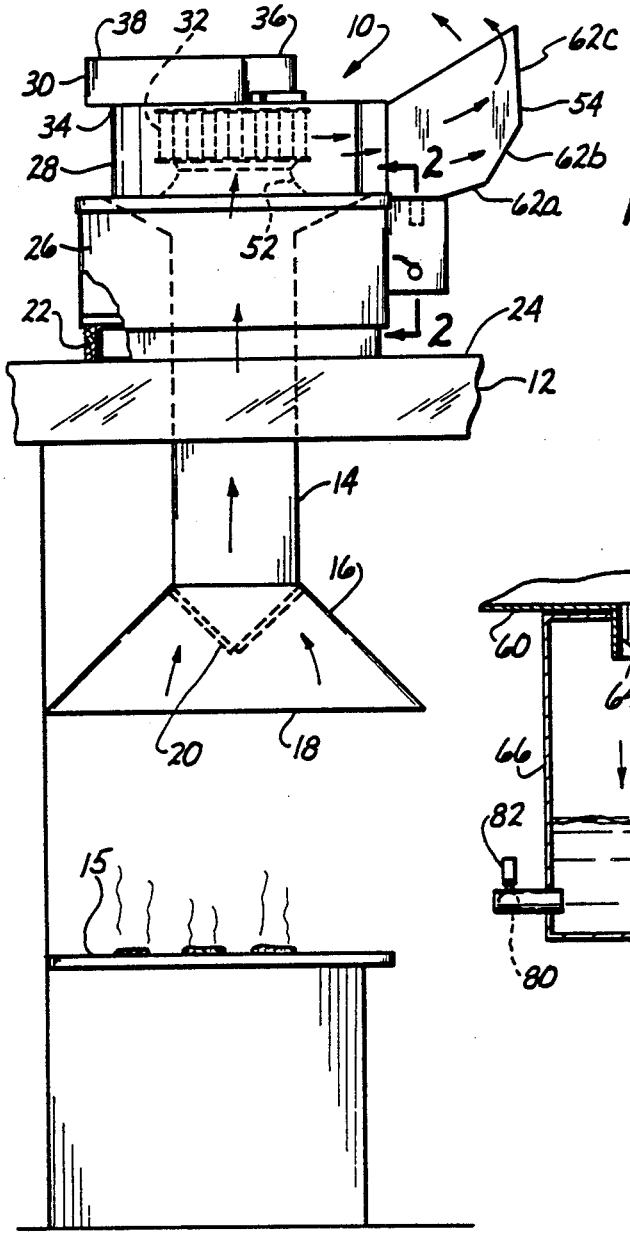
FIG. 1 is an elevational diagrammatic view of a typical kitchen hood/exhaust installation using the improved exhaust blower unit of this invention.
Figure 2:
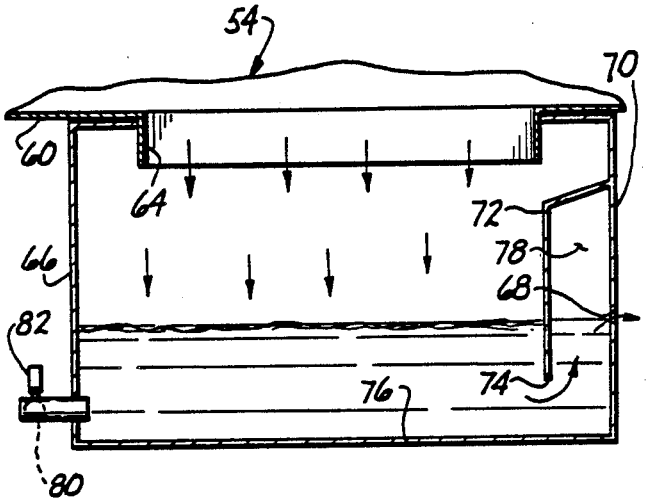
FIG. 2 is an elevational cross-section of the grease/-water separator of the improved exhaust blower unit.

With reference to the drawings, FIG. 1 shows a typical commercial kitchen installation with an exhaust blower unit 10 mounted on a kitchen roof 12 and connected with a kitchen hood 16 via an exhaust duct 14 which passes through an opening in the roof 12. The hood 16, overlies a cooking surface 15 such as a grill, broiler, stove or any other cooking equipment likely to produce undesirable fumes and grease laden air which require venting from the kitchen interior. The kitchen hood 16 is not described in detail as vaarious designs for such hoods are in use and are often tailored to the particular requirements of each installation. Generally, the hood 16 has open underside 18 into which air is drawn upwardly as suggested by the flow arrows in FIG. 1. The airflow passes through filters 20 and into the exhaust duct 14.

The roof mounted blower unit 10 is usually set on a raised, rectangular curb 22 which encloses the duct opening in the roof. The construction of curbs for installation of this type of equipment is well-known in the trade, since similar curbs are used for installation of air conditioning equipment and the like as well. Briefly, the curb is a wooden or steel rectangular frame on the roof surface 24 and is covered with weather-proofing material to prevent seepage of rain water into the duct opening.

Figure 3:
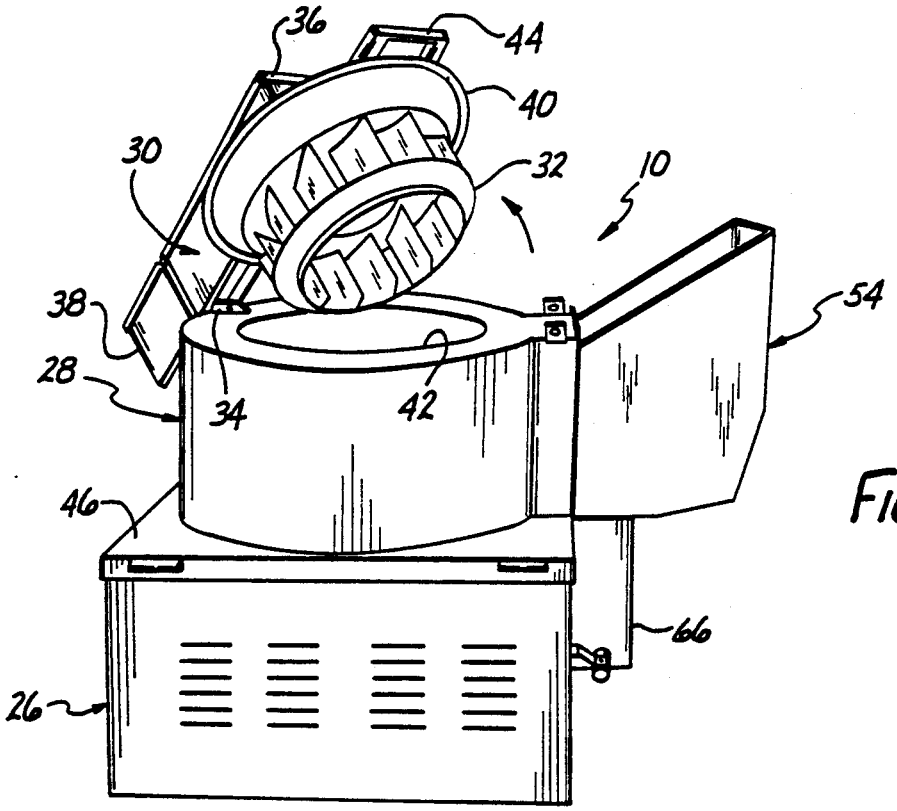
FIG. 3 is a perspective view of the improved exhaust blower unit showing the tilt-out blower wheel raised to its service access position.
Figure 4:
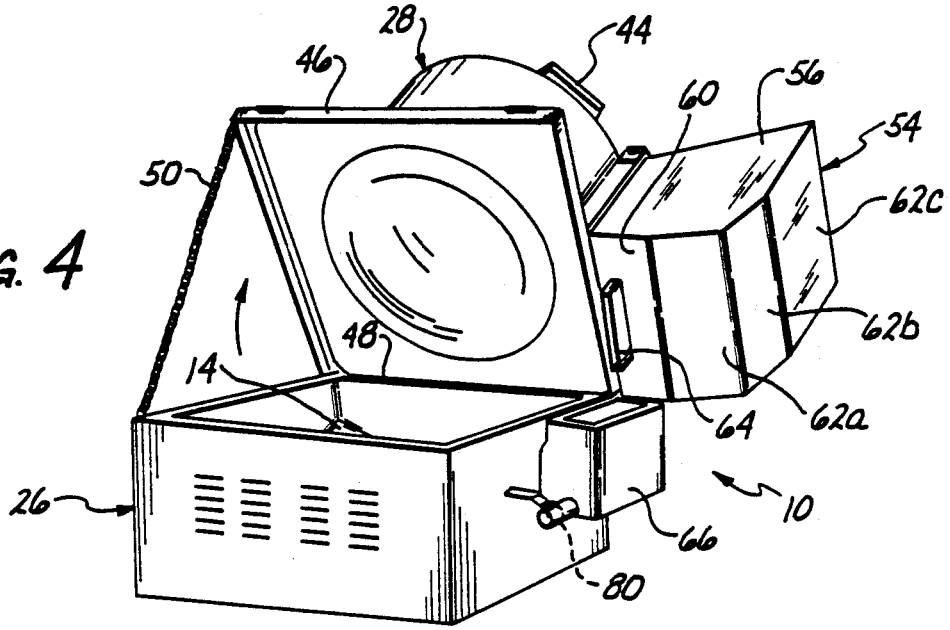
FIG. 4 is a perspective view of the blower unit of FIG. 3, shown with the blower housing raised for access into the base and the duct leading to the kitchen hood below.

The blower unit 10 includes three stacked sub-units: a base 26, a blower housing 28, and a weather-proof motor housing 30, as shown in FIGS. 3 and 4. In FIG. 1, the three sub-units 26, 28 and 30 are shown in normal operative position for drawing air from the duct 14 and exhausting it to the atmosphere. A centrifugal blower wheel 32 is mounted for rotation inside the motor housing 30, which is a generally elongated rectangular sheet metal box. The motor housing 30 is hinged at 34 to the blower housing 28 so that part of the motor housing is cantilevered and extends unsupported over the edge of the blower housing. The blower wheel 32 is mounted near the inner end 36 of the motor housing 30 while the drive motor (not shown in FIGS. 1–4) is mounted near the outer, cantilevered end 38. The drive motor is connected by a drive belt to a pulley mounted on the shaft of the blower wheel 32. The weight of the drive motor serves to balance, at least in part, the weight of the blower wheel 32. This balancing makes it easier to lift up the inner end 36 of the motor housing which carries the blower wheel 32. In the normal, operative position of FIG. 1 the blower wheel is contained within the blower housing 28. When the motor housing is lifted to the raised access position shown in FIG. 3 the blower wheel 32 is lifted through a circular opening 42 in the top of the blower housing 28 and is fully exposed for easy cleaning and inspection. A circular cover 40 is fixed to the underside of the motor housing 30 and serves to close off the circular opening 42 once the blower wheel has been lowered into the blower housing. A handle 44 is attached to the inner end 36 of the motor housing for use in lifting the same.

Figure 5:
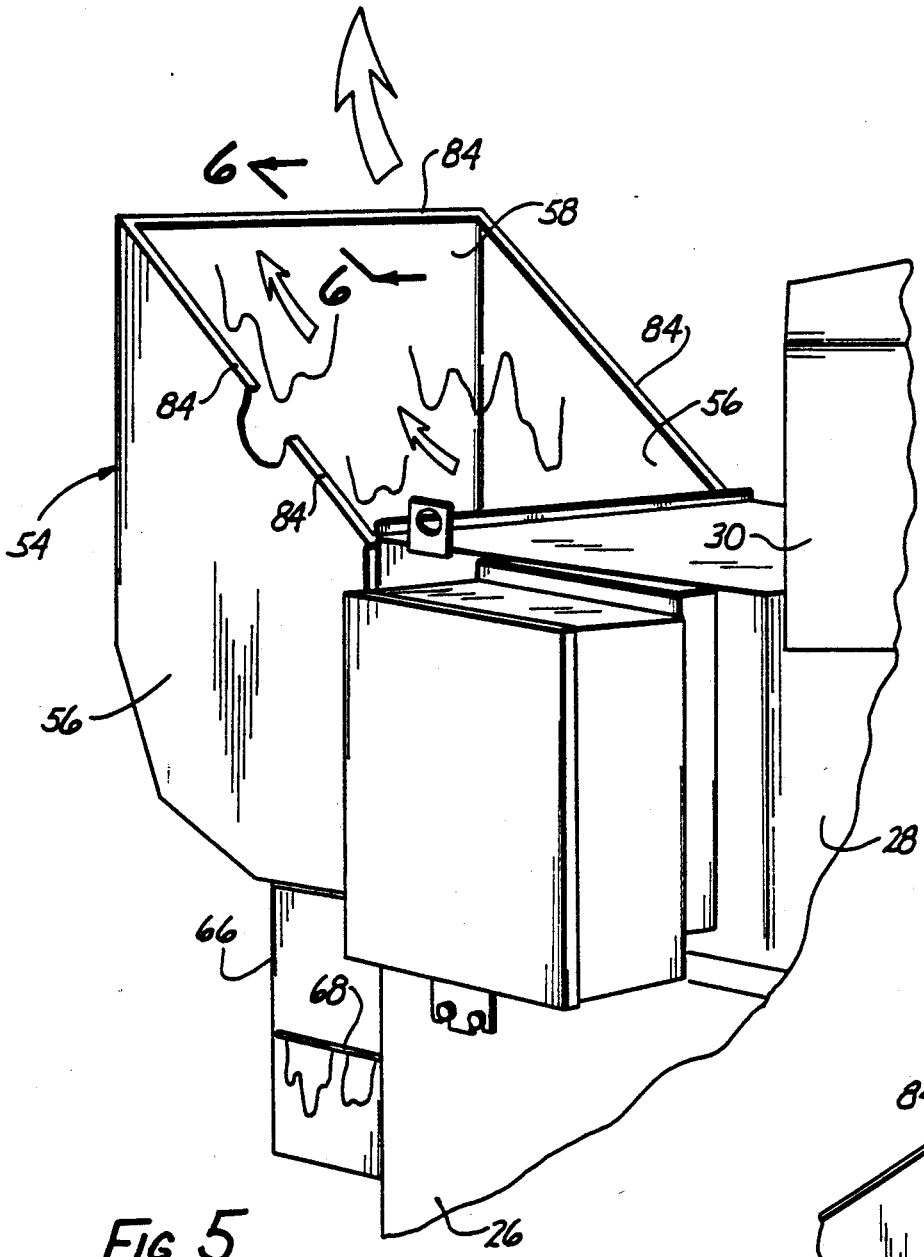
FIG. 5 is a fragmentary perspective view showing the improved discharge scoop of the grease exhaust blower unit of FIGS. 3 and 4.

The blower housing 28 is supported on a lid 46 hinged along edge 48 to the base 26. The lid can move between a closed operative position shown in FIG. 3 and an open position shown in FIG. 4 which allows easy access into the base and also into the upper end of the exhaust duct 14 which is enclosed by the base 26. While the unit is being serviced a support chain 50 holds the lid 46 in the open, elevated position of FIG. 4 against the weight of the motor housing and blower which are so arranged on the lid as to pull the lid towards a fully open position. The lid 46 also has a support stop 47 extending from the hinged side of lid 46 as shown in FIG. 5 which limits the opening of the lid. An intake funnel 52 is fitted into a circular central opening of the lid 46 and directs air into the center of the blower wheel 32 in the blower housing 28, as suggested in dotted lining in FIG. 1. The air is then driven radially to the exterior of the wheel into the blower housing 28 from which it must exhaust through the discharge duct 54. As can be seen, the base 26, blower housing 28 and motor housing 30 are hinged to each other as explained and allow nearly unrestricted access to all parts of the exhaust blower unit 10 for thorough cleaning, frequent inspection and easy maintenance.

Figure 6:
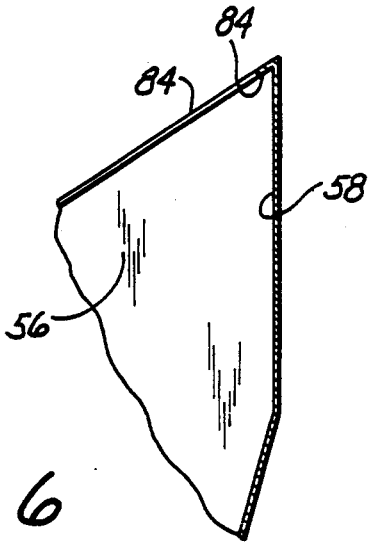

The discharge scoop 54 shown in FIGS. 1, 3, 4, and 5 deflects the horizontal exhaust from the blower housing 28 upwardly, as indicated by the flow arrows in FIGS. 1 and 6. The scoop 54 is constructed of sheet metal and has two vertical side walls 56 connected by a curved bottom or end wall 58. As best seen in FIGS. 1 and 4, the scoop wall 58 is assembled as a series of rectangular panels, starting at a horizontal panel 60 adjacent to the blower housing 28 and progresses through two intermediate incrementally angled panels 62*a*, 62*b* to a vertical end panel 62*c*.

The incrementally sloped panels comprising the scoop wall 58 define a reflux gradient for returning grease deposited on the inner surfaces of the scoop by the exhaust air stream to the inner panel 60 and drain slot 64. A grease container 66 is mounted to the side of the base 26 underneath the scoop drain slot 64. All material draining from the scoop through the slot 64 is collected in this container. The container 66 is a box with an open top which is covered by the bottom panel 60 of the exhaust scoop when the blower housing is in the lowered operative position of FIG. 3. When the blower housing is raised as in FIG. 4, the top of the container 66 is open.

Rain water or snow collected by the large scoop 54 does also collect in the container 66, along with the grease. The container 66 function as a flotation separator to trap grease while eliminating water. To that end, a horizontal overflow slot 68 opens at an intermediate level of one side wall 70 of the separator 66. A vertical partition 72 extends the full width of the container 66 to contain all fluids except through a low passage 74 between the lower edge of the partition 72 and the bottom 76 of the container. This opening 74 is below the level of the overflow slot 68 and the arrangement functions as a grease trap allowing heavier water to pass under the partition and overflow out of the container 66 while the lighter grease floats on top and is retained on the left hand side of the partition 74, i.e. within the main space of the container 66. The contents of container 66 can be removed periodically through a drain stub 80 equipped with a ball valve operated by means of a handle 82.

Rain water or melting snow will tend to sink under the grease, raising the grease above the level of opening 74. As additional water enters the container 66, it alone will flow under the partition 72 into space 78 and overflow from container 66 through the slot 68 onto the roof surface. The grease remains trapped within the container 66 floating on layer of water which at no time can exceed the level of the overflow slot 68. This arrangement prevents the common problem of rain water filling such grease containers and causing the grease itself to overflow onto the roof surface.

Still another feature of the improved blower unit 10 directed towards reducing and controlling the quantity of condensed grease discharged by the unit 10, is the provision, shown in FIG. 5 and 5A, of inturned lips 84 along the upper edges of both sidewalls 56 and the end panel 62c of the discharge scoop. The lips 84 are relatively narrow so as not to significantly obstruct air flow from the scoop, yet effectively contain condensed grease driven along the inner surfaces of the scoop walls towards the upper edges by the strong flow of exhaust air drive by the blower wheel. Without the grease containment flanges 84, such grease would eventually be driven from the scoop into the atmosphere, or overflow the edges of the scoop and drip down along the exterior surfaces of the scoop, contributing to roof-top grease accumulation and covering the outer scoop walls. In the improved exhaust blower unit of this invention, the grease instead will tend to accumulate underneath and along the containment flanges 84 until a build-up of sufficient weight is able to overcome the pressure of the exhaust air flow and reflow along the scoop walls towards the drain 64 and into the grease trap 66, the process repeating as long as the blower operates.

The preferred embodiment of the invention have been shown and illustrated for purposes of clarity and example only, and it will be understood that many changes, substitutions and modifications to the described embodiments will become readily apparent in light of the foregoing description to those possessed of ordinary skill in the art without thereby departing from the spirit and scope of the present invention which is defined by the following claims.

What is claimed is:

1. A kitchen grease exhaust blower for roof mounting, comprising:

a blower housing for mounting in communication with an exhaust duct;

an air discharge scoop fixed to said blower housing;

a motor driven blower wheel supported in said housing for drawing air from the exhaust duct and exhausting the air through said scoop; and container means for collecting fluid from said scoop including flotation separator means for eliminating water while retaining lighter-than-water fluids in said container means.

2. A kitchen grease exhaust blower for roof mounting, comprising:

a base for supporting an upper end of an exhaust duct communicating with a ventilation hood for extracting grease laden air over a cooking surface;

a discharge scoop fixed to said blower housing; and a motor driven blower wheel supported in said housing for exhausting air from said base through said scoop;

characterized in that said scoop has edges defining a discharge opening, said edges being bent inwardly to said opening to contain and collect grease being carried by said exhausting air along inner scoop surfaces toward said opening, thereby keeping the grease from discharging onto a surrounding roof surface.

3. The blower of claim 2 further comprising:

a grease trap mounted to said base for collecting grease drippings from a drain opening in said scoop;

said scoop being shaped for returning by gravity flow grease collected at said bent edges to said drains opening for collection in said trap.

4. The blower of claim 3 wherein said scoop has two vertical side walls connected by a bottom wall bent progressively between a generally horizontal lower portion adjacent to said blower housing and a generally vertical end portion, said drain opening being in said lower portion, so as to encourage gravity flow of grease collecting on said side walls and said end portion towards said drain opening for collection in said grease trap.

5. The blower of claim 3 said grease trap including container means for collecting fluid from a drain slot in said scoop including flotation separator means for eliminating water while retaining lighter-than-water grease in said grease trap.

6. A roof mountable kitchen grease exhaust blower comprising:

a base for supporting an upper end of an exhaust duct communicating with a ventilation hood for extracting grease laden air over a cooking surface;

a blower housing hinged to said base for movement between a closed operative position and a raised maintenance position;

a discharge scoop fixed to said blower housing;

a motor driven blower wheel supported in said housing for exhausting air from said base through said scoop;

said blower wheel supported in a motor housing hinged to said blower housing for movement between a closed operative position and an exposed maintenance position;

container means for collecting fluid from a drain slot in said scoop including flotation separator means for eliminating water while retaining grease in said container means.

7. The blower of claim 6 further characterized in that said scoop has edges defining a discharge opening, said edges being bent inwardly to said opening to contain and collect grease being carried by said exhausting air along inner scoop surfaces toward said opening, thereby keeping the grease from discharging onto a surrounding roof surface.

8. The blower of claim 7 wherein said scoop has two vertical side walls connected by a bottom wall bent progressively between a generally horizontal lower portion adjacent to said blower housing and a generally vertical end portion, said drain opening being in said lower portion, so as to encourage gravity flow of grease collecting on said side walls and said end portion towards said drain opening for collection in said grease trap.

9. The blower of claim 8 wherein said container means is an open container positioned underneath a drain opening in said scoop for collecting grease drippings, and said separator means comprise a vertical partition in said container open at a low level, and overflow opening in said container at a higher level on one side of said partition, said container being positioned such that said grease drippings are received on the opposite side of said partition, such that rain water collected in said scoop and flowing into said container is eliminated through said overflow opening while collected grease remains floating on said other side of said partition for subsequent disposal.

* * * * *